US005235809A

United States Patent [19]

Farrell

[11] Patent Number: 5,235,809

[45] Date of Patent: Aug. 17, 1993

[54] HYDRAULIC CIRCUIT FOR SHAKING A BUCKET ON A VEHICLE

[75] Inventor: Robert G. Farrell, Romeo, Mich.

[73] Assignee: Vickers, Incorporated, Troy, Mich.

[21] Appl. No.: 756,539

[22] Filed: Sep. 9, 1991

[51] Int. Cl.[5] ..... F16D 31/02

[52] U.S. Cl. ..... 60/445; 60/452; 60/468; 60/494; 91/461

[58] Field of Search ..... 60/445, 452, 459, 465, 60/468, 427, 433

[56] References Cited

U.S. PATENT DOCUMENTS

| | | | |
|---|---|---|---|
| 3,203,165 | 8/1965 | Parr | 60/445 X |
| 3,834,836 | 9/1974 | Hein et al. | 60/445 X |
| 4,201,052 | 6/1980 | Breeden et al. | 60/445 |
| 4,201,502 | 5/1980 | Skendrovic | 408/1 |
| 4,407,122 | 10/1983 | Nanda | 60/452 |
| 4,475,442 | 10/1984 | Breeden | 60/461 X |
| 4,480,527 | 11/1984 | Lonnemo | 91/438 X |
| 4,523,430 | 6/1985 | Masuda | 60/452 X |

*Primary Examiner*—Edward K. Look
*Assistant Examiner*—Todd Mattingly
*Attorney, Agent, or Firm*—Barnes, Kisselle, Raisch, Choate, Whittemore & Hulbert

[57] ABSTRACT

A hydraulic system for a vehicle that includes an implement such as a bucket that is operated by a hydraulic actuator and a directional valve which controls flow from a load sensing variable displacement pump. A hydraulic bucket shake circuit is provided which is selectively operable to force the pump to a maximum displacement condition thereby providing standby pressure and flow to the directional valve so that the directional valve can be operated rapidly in order to shake the bucket and dislodge mud, clay and debris from the bucket or to allow penetration into frozen ground.

6 Claims, 5 Drawing Sheets

HYDRAULIC CIRCUIT FOR SHAKING A BUCKET ON A VEHICLE

This invention relates to hydraulic circuits and particularly to hydraulic circuits for off-the-road vehicles and the like which include an implement such as a bucket.

BACKGROUND AND SUMMARY OF THE INVENTION

In off-the-road vehicles it is common to utilize a an implement such as a bucket for handling dirt wherein the bucket is utilized to lift the dirt as well as, in some vehicles, in a manner of a backhoe. In such a hydraulic system, it is desirable to be able to shake the bucket in order to dislodge mud, clay or debris from the bucket. It is also desirable to be able to penetrate frozen ground. Open center hydraulic systems commonly in use today are capable of rapidly shaking the bucket. On the other hand, where the hydraulic system comprises a directional valve for controlling flow to the hydraulic actuator of the bucket and a load sensing variable displacement pump for delivering fluid to the directional valve, the hydraulic system is not capable of providing rapid shaking of the bucket. Load sensing systems function more slowly to demand than comparable open center hydraulic systems. It is therefore desirable to provide a hydraulic circuit for load sensing variable displacement pump systems.

Accordingly, among the objectives of the present invention are to provide a hydraulic system for operating a bucket which includes a load sensing variable displacement pump wherein hydraulic fluid may be selectively provided to a directional valve so that it is readily available for shaking a bucket or the like; which can be readily adapted to present hydraulic systems; which can be adapted at relatively low cost in the modification of such systems; which overlaps any delay as presently occurs in load sensing variable displacement pump systems.

In accordance with the invention, in a hydraulic system for a vehicle that includes an implement such as a bucket that is operated by a hydraulic actuator, a directional valve which controls flow from a load sensing variable displacement pump, a hydraulic bucket shake circuit is provided which is selectively operable to force the pump to a maximum displacement condition thereby providing standby pressure and flow to the directional valve so that the directional valve can be operated rapidly in order to shake the bucket and dislodge mud, clay and debris from the bucket or to allow penetration into frozen ground.

DESCRIPTION

Figure 1:
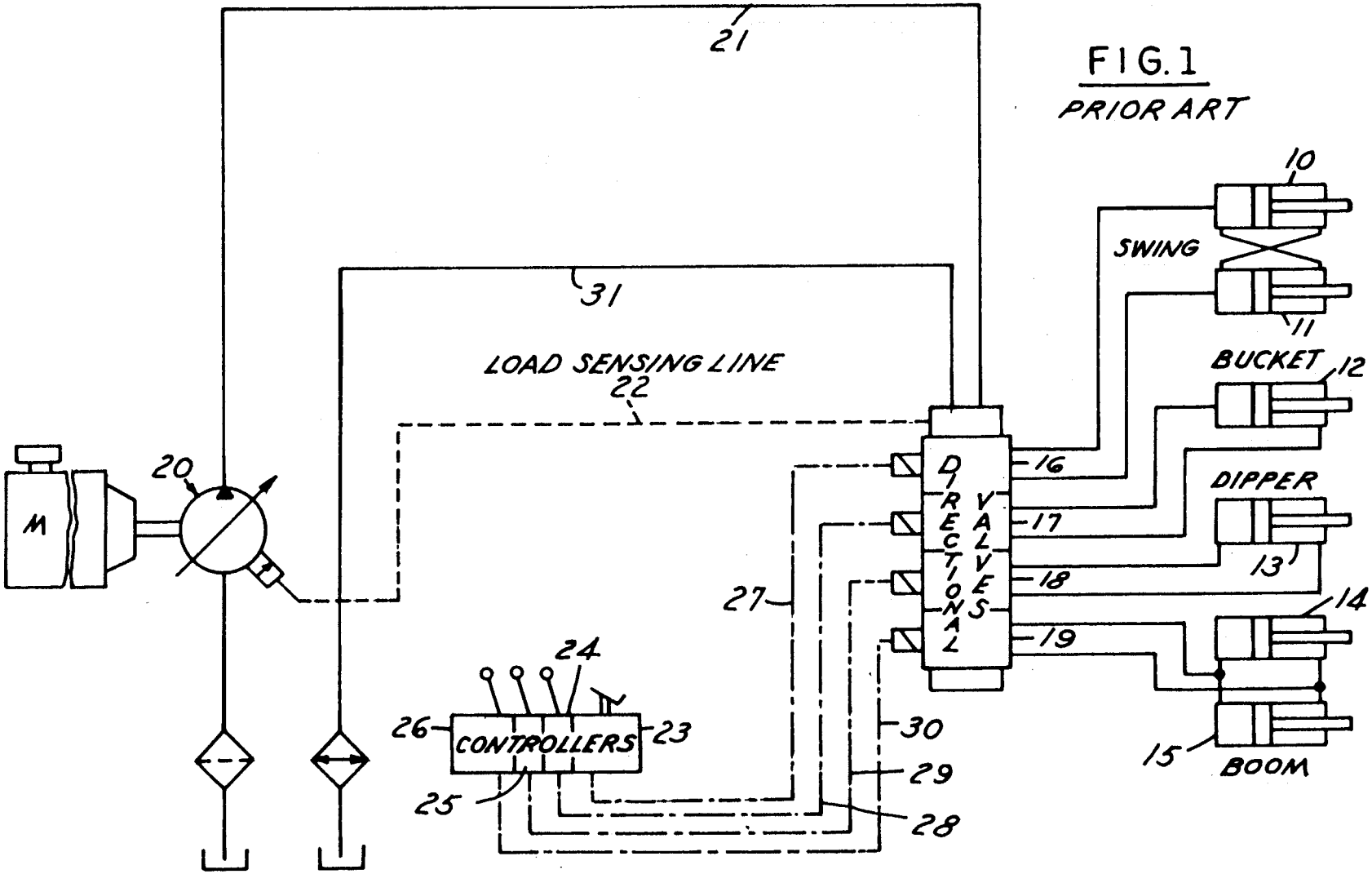
FIG. 1 PRIOR ART
FIG. 1 is a schematic diagram of a prior art hydraulic circuit as used for operation of a bucket.

This invention is particularly applicable to load sensing variable displacement hydraulic pump circuits of the type incorporating a directional valve. Referring to FIG. 1, in a typical circuit for operating a plurality of implements on a vehicle, each of the implements is operated by hydraulic actuators 10–15 to which hydraulic fluid is supplied through lines from directional valves 16–19. Hydraulic fluid is supplied to a bank of directional control valves 16–19 by a line from a variable displacement pump 20 driven by a motor or engine M. A load sensing line 22 is operable to vary the displacement of the pump in a manner well known in the art such as shown in U.S. Pat. No. 4,201,052. Controllers 23, 24, 25, and 26 are associated with each directional valve 16–19 to operate the directional valves 16–19 and, in turn, operate the respective actuators. A line 31 extends from the bank of directional valves 16–19 to the tank. Controllers 23–26 can be hydraulic, providing pilot pressure to the directional valve or electric, providing a current or voltage signal to the directional valves.

In accordance with the invention, the hydraulic circuit associated with the implement such as a bucket is modified by inclusion of a control bucket shake circuit that is selectively operable by the operator.

Figure 2:
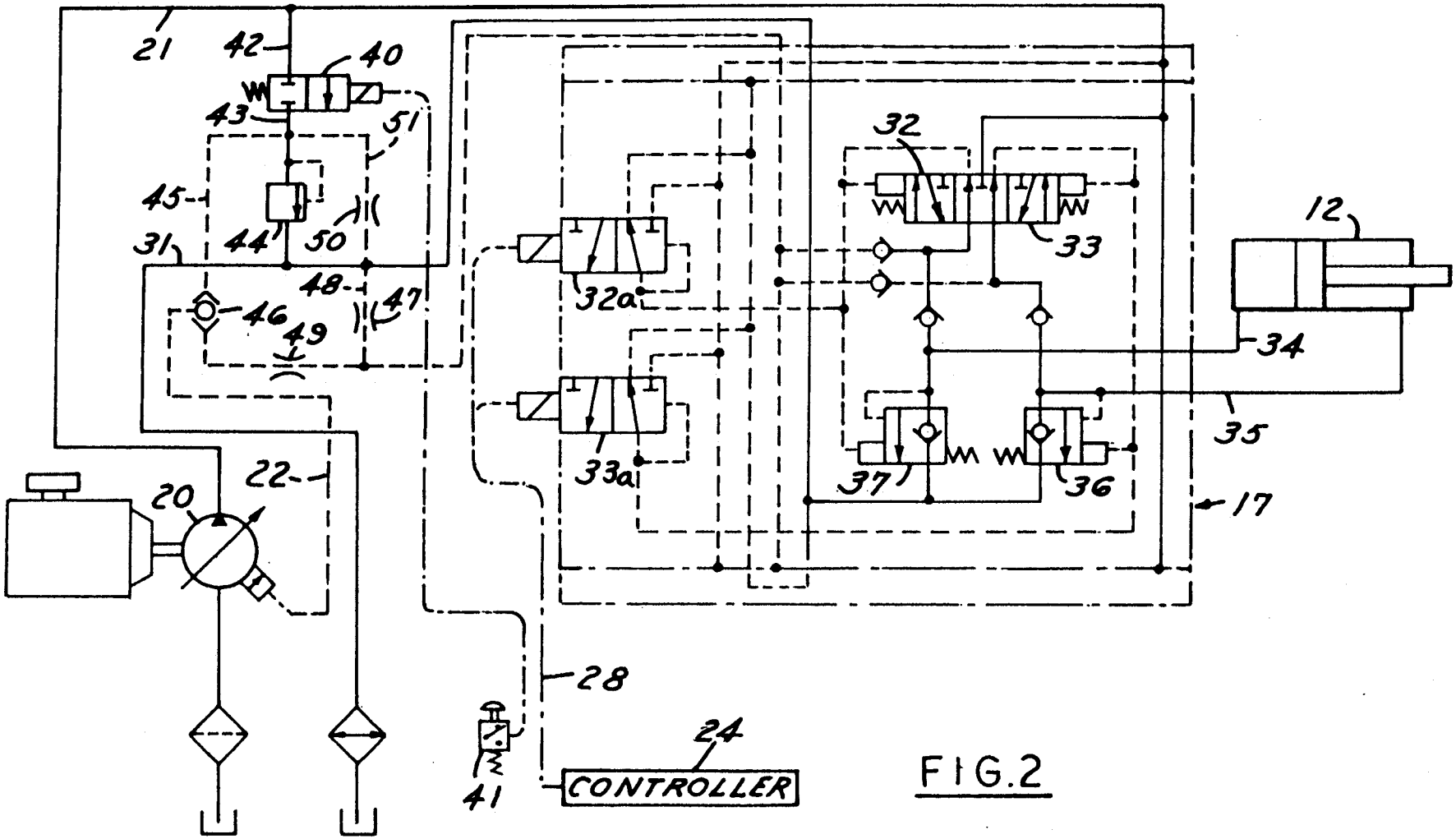
FIG. 2 is a schematic hydraulic circuit for a portion of such a system embodying the invention.

In the form of the invention shown in FIG. 2, the bucket shake circuit is shown as applied to the bucket actuator 12 and directional valve 17. The invention is particularly applicable to hydraulic circuits of the type shown in U.S. Pat. Nos. 4,201,502, 4,407,122 and 4,475,442, incorporated herein by reference.

In such circuits, directional valve 17 comprises a meter-in valve 32, which is controlled by pilot pressure through pilot stage pressure reducing valves **32*a*, 33*a*. Reducing valves 32*a*, 33*a* are controlled by a controller 24 through an electric line 28. Depending upon the direction of movement of the valve, hydraulic fluid passes through lines 34, 35 to one or the other end of the actuator 12. The hydraulic system further includes a meter-out valve 36, 37 associated with each end of the actuator 12 for controlling the flow of fluid from the end of the actuator to which hydraulic fluid is not flowing from the pump to a tank passage. In all other respects the hydraulic circuit is shown and described in the aforementioned U.S. Pat. Nos. 4,201,052 and 4,480,527, incorporated herein by reference. Alternatively, the controller 24** may control pilot pressure to the meter-in valves.

Referring to FIG. 2, the bucket shake circuit comprises a solenoid operated two-way valve 40, the solenoid of which is controlled by a manually operated switch 41 which is normally open. Valve 40 is connected by valve inlet line 42 and relief valve inlet line 43, across pump outlet line 21 and return line 31 and has a relief valve 44 associated therewith in relief inlet line 43 that is connected by an intermediate line 45 and shuttle valve 46 to load sensing line 22. An orifice 47 is provided in a second branch line 48 between return line 31 and load sensing line 22 and an orifice 49 is provided in line 22 between line 48 and shuttle valve 46.

There are two modes of operation for the bucket shake circuit; inactive and active. During normal machine operations the inactive mode is applicable, i.e., switch 41 is not energized and the bucket shake circuit does not function. As can be seen, the relief valve 44 has its relief valve inlet line 43 connected through first branch line 51 and orifice 50 to return line 31 and thus to tank. The relief valve 44 will thus stay closed. Also, note that intermediate line 45 is also connected to tank through first branch line 51, orifice 50 and return line 31. The load sensing line 22 is thus blocked from the return line 31 by the valve 46, and is connected to the directional valves 16 through 19 in the usual load sensing manner.

The bucket shake circuit is activated by holding switch 41 closed. This causes valve 40 to shift. Fluid, from the pump outlet line 21, is then connected to the load sensing line 22 via valve inlet line 42, valve 40, lines 43 and 45, and valve 46. The pump outlet pressure and load sensing pressure will thus be approximately equal. The pump control always tries to maintain a constant pressure differential between these two and will increase the pump displacement until this differential is satisfied or full displacement is obtained. In this bucket shake circuit, the pump will go to full stroke and its output flow will pass across the relief valve 44 to the return line 31. The pressure in line 21 will therefore be at the relief valve setting. Thus, full pump flow at high pressure is available near the inlet port of any of the directional valves 16–19. The delays associated with (1) the pump increasing its displacement and (2) having to pressurize line 21 have thus been eliminated.

Figure 3:
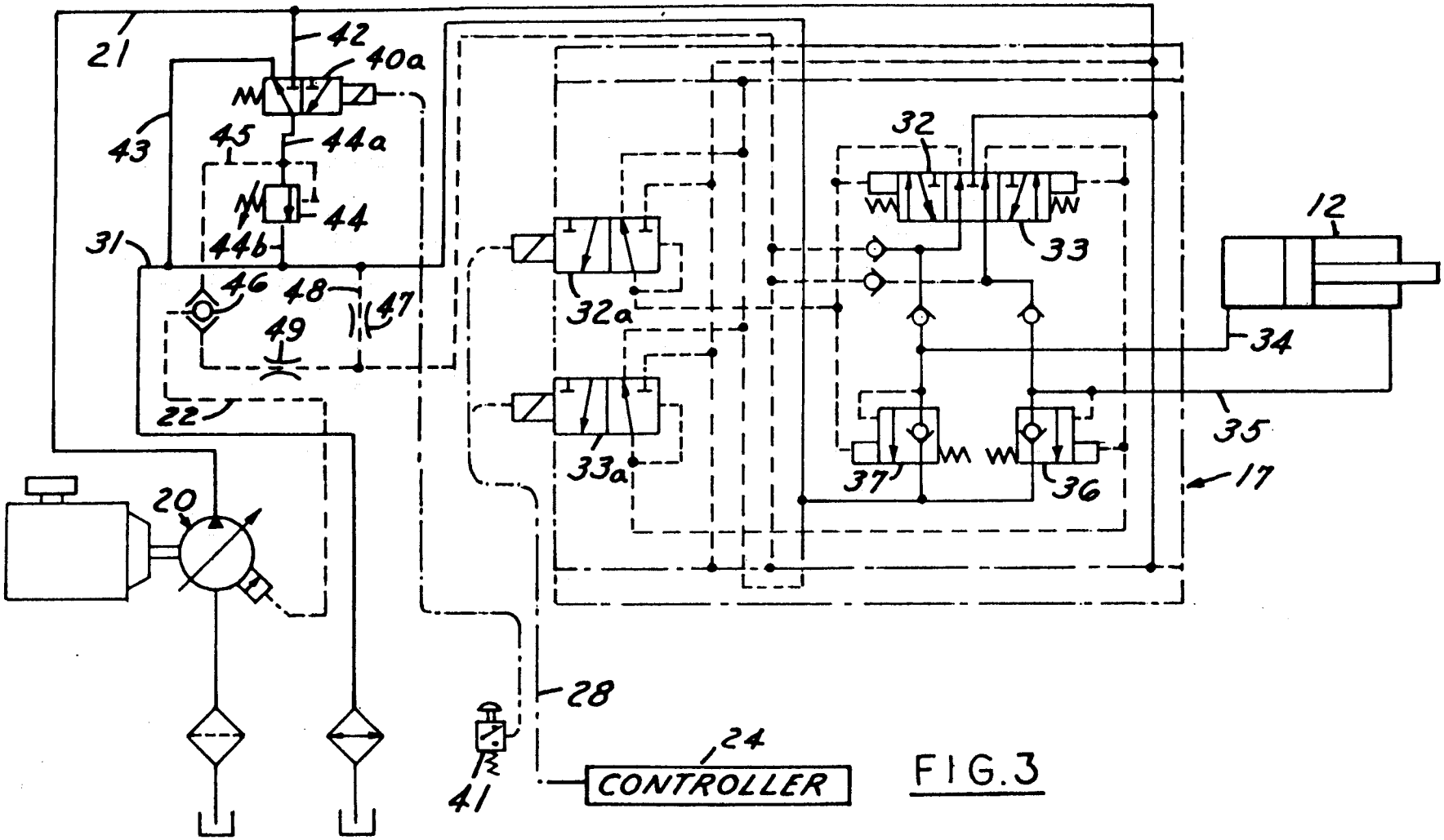
FIG. 3 is a schematic hydraulic circuit of another circuit.

In the form of circuit shown in FIG. 3, the circuit is identical to that shown in FIG. 2 except for the deletion of orifice 50 and the associated line 51 and the substitution of a three-way valve, 40*a*, in place of the two-way valve 40. In the inactive mode, the pressure in line 45 bleeds to tank via line 45*a*, valve 44 and line 43. In the active mode, the valve 40*a* connects the pump outlet once again to the load sensing line 22.

Figure 4:
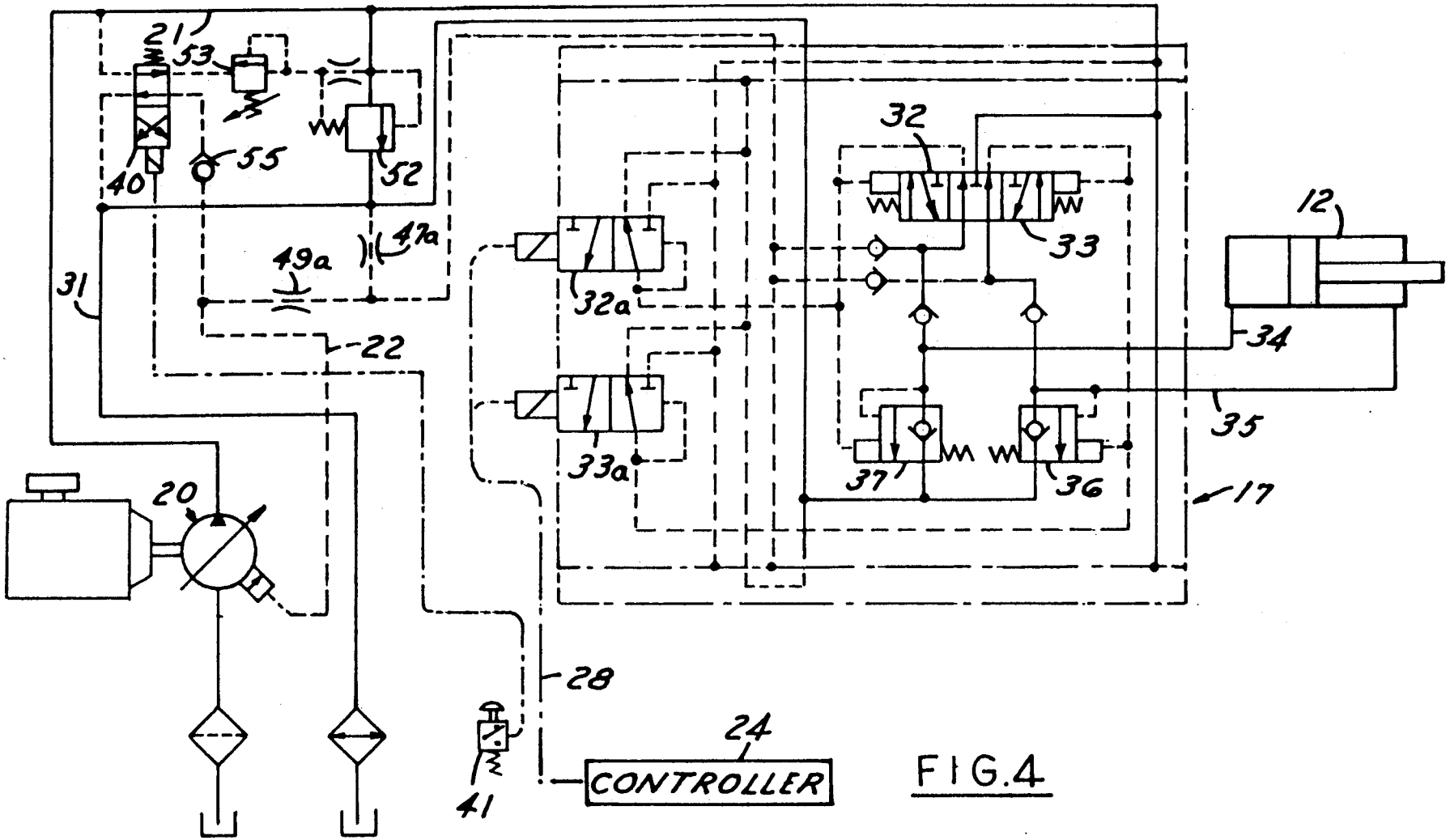
FIG. 4 is a schematic hydraulic circuit of another circuit.

In the bucket shake circuit shown in FIG. 4, the solenoid valve 40 is associated with a relief valve 52 and an associated pilot stage 53 as well as the orifices 47*a*, and 49*a* which function as bleed-off and dampener respectively.

Instead of a shuttle valve, a check valve 55 is provided. In this form, when the bucket shake circuit is in the inactive mode, switch 41 is deenergized and the valve 40 is in the position shown. Pilot stage 53 and thus valve 52 are closed, therefore, the pump outlet is blocked and the load sensing line 22 again bleeds to tank line 31 via orifice 49*a* and 47*a*.

In the active mode, switch 41 is energized and valve 40 is shifted t vent pilot stage 53 to the tank. This controls and causes valve 52 to act as a relief valve. Valve 40 also connects the line 21 to line 22 via check valve 55.

Figure 5:
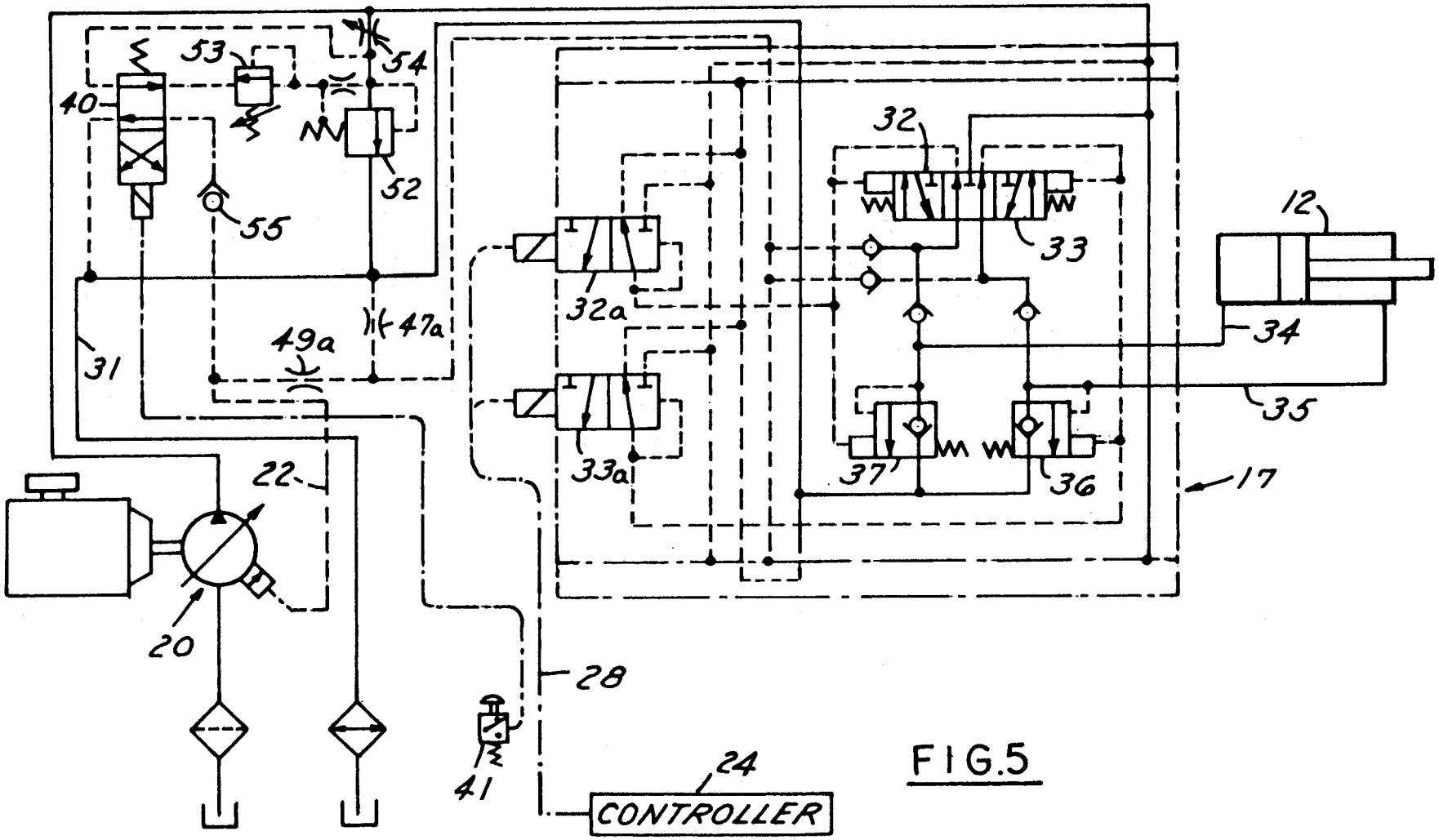
FIG. 5 is a schematic of still another circuit.

In the form shown in FIG. 5, the bucket shake circuit is substantially like that in FIG. 4 except that the variable orifice 54 is added. When circuit is in the inactive mode there is no difference between the circuits of FIG. 4 and FIG. 5.

However, in the active mode, the orifice 54 creates a pressure drop between lines 21 and 22 and, thus, is a means for adjusting what the flow rate will be across the valve 52. It is a simple means for limiting this flow if the bucket shake action does not require the full pump flow.

It can thus be seen that there has been provided a bucket shake system that can be used with a hydraulic system having a variable displacement pump that is controlled by sensing the load in the system which may have an inactive mode and an active mode. In the active mode, the bucket control system senses the pressure in the flow from the pump and causes the associated relief valve to open providing a large flow and high pressure to the directional valve of the hydraulic system as may be required, for example, to shake a bucket.

I claim:

1. A hydraulic system for a vehicle that includes a bucket or the like comprising, a hydraulic actuator having a pair of openings, a directional valve connected to said openings of said actuator for selectively directing fluid to and from said openings, means for actuating said directional valve to a plurality of operating positions to thereby control the movement of the actuator, a load sensing variable displacement pump, a hydraulic line extending from said pump to said directional valve for providing fluid to said directional valve, a load sensing line between the actuator and the pump and which normally provides a connection between said directional valve and the pump, a return line from said directional valve to a tank passage, and a hydraulic bypass circuit connected between said actuator and said pump which in a first mode permits normal functioning of said flow to said directional valve by the variable displacement pump, and which is operable in a second mode to force the pump to a maximum displacement condition thereby providing standby pressure and flow to the directional valve so that the directional valve can be operated rapidly in order to shake the bucket and dislodge mud, clay and debris from the bucket or to allow penetration into frozen ground, a manual control means for said hydraulic bypass circuit having an inactive mode and an active mode such that in the active mode, said bypass circuit provides fluid to force the pump to a maximum displacement, said hydraulic bypass circuit comprising first valve means connected across said pump outlet line and said return line, and means operable in response to actuation of said manual control means to an active position to interrupt the application of fluid from the pump to the actuator and to provide said standby pressure to said directional valve.

2. A hydraulic system set forth in claim 1 wherein said means operable in response to actuation of said manual control means comprises a relief valve connected between said firs valve means and said return line.

3. A hydraulic system set forth in claim 2 wherein said hydraulic bypass circuit includes, a relief valve inlet line connected between said first valve means and said relief valve, a first branch line connected between said relief valve inlet lie and said return line, a first orifice positioned within said first branch line, a second branch line between said return line and said load sensing line, a second orifice located within said second branch line, a shuttle valve, an intermediate line between said shuttle valve and said relief valve inlet line, a third orifice within said load sensing line between said second branch line and said shuttle valve, said shuttle valve being connected between said load sensing line and said return line such that in said first mode when the manual control means is not activated, said relief valve inlet line is connected to tank through said first branch line, sad first orifice and said return line and said load sensing line is blocked from said return line by said shuttle valve and when the manual control means is moved to said second mode the fluid flows from the pump outlet line to the load sensing line via valve inlet line to said first vale means, relief valve inlet line, intermediate line and shuttle valve.

4. A hydraulic system set forth in clam 1 wherein said first valve means is a three-way valve, a relief valve inlet line connected between said three way valve and said relief valve, a first branch line connected between said relief valve inlet line and said return line, 'a first orifice positioned within said first branch line, a first branch line between said return line and said load sensing line, a first orifice located within said second branch line, a shuttle valve, a second orifice within said load sensing line between said first branch line and second first valve means, said shuttle valve being connected between said load sensing line and said return line such that, in the inactive mode, said relief valve inlet line is connected to tank through said first branch line, said return line and said load sensing line is blocked from said return line by said shuttle valve and when the manual control means is moved to an active mode the fluid flow from the pump outlet line to the load sensing line via valve inlet line to said first valve means, relief valve inlet line, intermediate line and shuttle valve.

5. A hydraulic system set forth in claim 1 wherein said first valve means is a four-way valve, a relief valve inlet line connected between said three way valve and said relief valve, a first branch line connected between said relief valve inlet line and said return line, a first orifice positioned within said first branch line, a first branch line between said return line and said load sensing line, a first orifice located within said second branch line, a check valve, a second orifice within said load sensing line between said first branch line and said first valve means, check valve being connected between said load sensing line and said return line such that, in the inactive mode, said relief valve inlet line is connected to tank through said first branch line, said return line and said load sensing line is blocked from said return line by said check valve and when the manual control means is moved to an active mode the fluid flows from the pump outlet line to the load sensing line via valve inlet line to said first valve means, relief valve inlet line, intermediate line and check valve.

6. A hydraulic system set forth in claim 5 further comprising, a variable orifice connected between said three-way valve and said pump outlet line such that in the active mode, said variable orifice creates a pressure drop between said pump outlet and said load sensing line for adjusting the flow rate across said three-way valve.

* * * * *